United States Patent [19]

Savage

[11] Patent Number: 4,663,843

[45] Date of Patent: May 12, 1987

[54] RAZOR WITH ANGLED-EDGE BLADES

[76] Inventor: Brian D. Savage, 1821-A Arboretum Cir., Birmingham, Ala. 35216

[21] Appl. No.: 864,335

[22] Filed: May 19, 1986

[51] Int. Cl.[4] ..... B26B 21/22; B26B 21/28

[52] U.S. Cl. ..... 30/48; 30/50

[58] Field of Search ..... 30/48, 50, 49

[56] References Cited

U.S. PATENT DOCUMENTS

| | | | |
|---|---|---|---|
| 1,506,533 | 8/1924 | Klecka | 30/48 |
| 1,633,139 | 6/1927 | Staats-Oels | 30/50 |
| 2,614,321 | 10/1952 | Ackerman | 30/49 X |
| 2,713,201 | 7/1955 | Plesch | 30/50 |
| 2,794,252 | 6/1957 | Plesch | 30/50 X |
| 4,590,674 | 5/1986 | Harper | 30/50 |
| 4,603,477 | 8/1986 | Francis | 30/50 |

*Primary Examiner*—Jimmy C. Peters

*Attorney, Agent, or Firm*—Jennings, Carter, Thompson & Veal

[57] ABSTRACT

A shaving razor utilizes a trailing blade aligned along the longitudinal axis of the razor's shaving head for trimming and at least one leading blade for primary shaving. The cutting edge of the leading blade is aligned diagonally to the cutting edge of the trailing blade and therefore slices through the hair or beard at a different angle of attack than does a conventional blade, thereby reducing drag and yielding a smoother shave.

2 Claims, 6 Drawing Figures

RAZOR WITH ANGLED-EDGE BLADES

FIELD OF THE INVENTION

The present invention relates to razors for shaving and more particularly to razors wherein the blades are affixed to a shaving head in a predetermined orientation. More particularly the present invention relates to a razor having at least one blade, the edge of which is inclined diagonally relative to the longitudinal axis of the shaving head.

BACKGROUND OF THE INVENTION

Disposable shaving instruments are well known and are in common use. These instruments typically comprise a hardened plastic-like shaving head which supports one or more blades aligned along its longitudinal axis. The blade edges are held at a predetermined cutting angle such that the blade is moved perpendicular to the beard or hairs to be cut. The individual hairs are severed by forcing the sharpened edge through the hair, thus the blade tends to pull the beard in response to the resistance of the hair to the severing action. Therefore, many efforts have been made to soften the beard or to lubricate the skin to lessen the discomfort associated with shaving and to increase the closeness of the shave. However, no consideration appears to have been given to the mechanics of severing the individual hairs.

SUMMARY OF THE INVENTION

It is the object of the present invention to provide a razor that gives a smoother, closer shave.

The disadvantages of the prior art are overcome and the object of the present invention is accomplished by aligning the cutting edge at a more efficient angle of attack relative to the beard. That is to say, the cutting edge of the blade is aligned diagonally with respect to the longitudinal axis of the shaving head and therefore slices through the beard due to relative motion of the blade edge across the hair. The individual hairs are thus cut with the same action as occurs in scissors, knives and other like implements wherein the sharpness of the blade is enhanced by the relative motion thereof with the material being cut. My razor retains one blade conventionally aligned parallel to the longitudinal axis of the shaving head and incorporates at least one other blade carried by the shaving head aligned diagonally to the first blade. The diagonally aligned blade is positioned to engage the beard during the normal shaving stroke and the conventionally aligned blade is used for trimming, as at side burns or under the nose.

BRIEF DESCRIPTION OF THE DRAWINGS

Apparatus embodying features of my invention are illustrated in the accompanying drawings, which form a portion of this application, and wherein.

DESCRIPTION OF A PREFERRED EMBODIMENT

Figure 1:
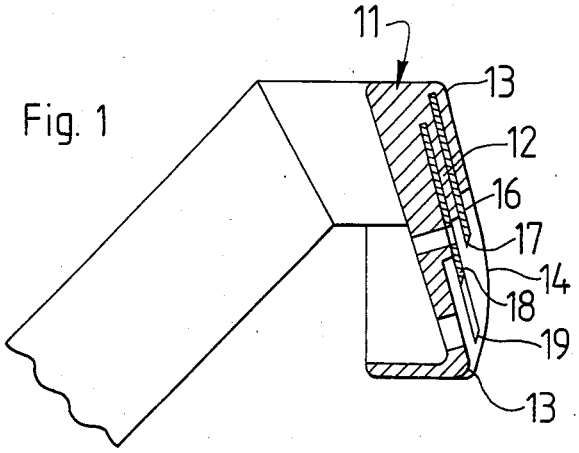
FIG. 1 is a sectional view taken along line 1—1 of FIG. 2.
Figure 2:
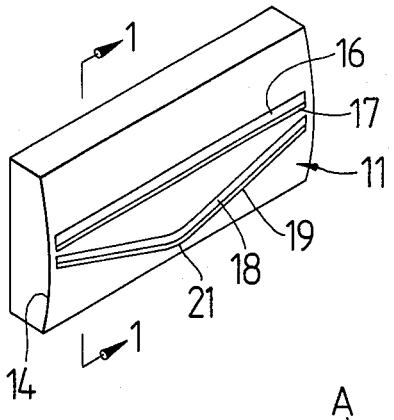
FIG. 2 is a perspective view of one embodiment showing a shaving head with the diagonally aligned cutting edges forming a V-shaped cutting surface.

Referring to FIGS. 1 and 2, I provide a shaving head 11 which is substantially conventional in that it is made from a hardened plastic material, is generally rectilinear and has blade spacers 12 formed therewithin, has generally conventional skin engaging surfaces 13 along its periphery, and skin engaging runners 14 at each end. The shaving head supports a trailing blade 16 which has a cutting edge aligned parallel to the longitudinal axis of the head 11 as is convention. A leading blade 18 is mounted in a parallel plane to the trailing blade 16; however, the cutting edge 19 of the leading blade 18 is aligned diagonally to the cutting edge 17 of the trailing blade. Thus, as the shaving head 11 is drawn across the skin in a conventional manner, the cutting edge 19 slices through the hair at a different angle of attack than would cutting edge 17.

Figure 6:
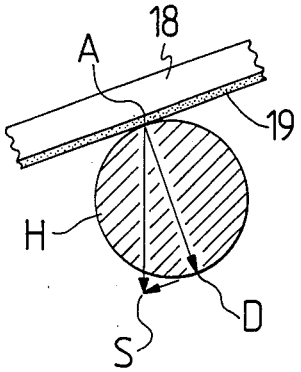

This effect is illustrated in FIG. 6. The cutting edge 19 engages the hair H at point A, and is moved by the shaving stroke along the line AS. For the hair H to be severed the blade must move due to force applied along line $\overline{AS}$ which may be resolved into components $\overline{AD}$ and $\overline{DS}$, which are respectively perpendicular to and parallel to blade edge 19. The component $\overline{AD}$ corresponds to the conventional relative movement of a blade through the hair H; however, with my improved razor there is additionally the component $\overline{DS}$ parallel to the edge of the blade which yields the same result as relative movement of the blade 19 through the hair H along DS, to wit: improved performance and less resistance to the cutting forces.

Figure 3:
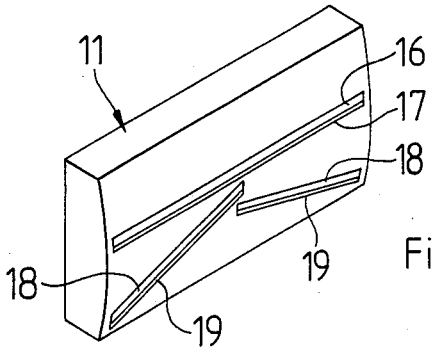
FIG. 3 is a perspective view of another embodiment wherein cutting edges are aligned on opposing diagonals.
Figure 4:
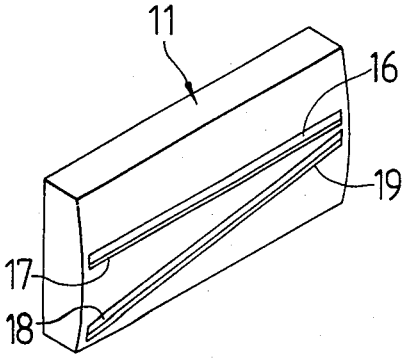
FIG. 4 is a perspective view of an embodiment with one diagonally aligned cutting edge.
Figure 5:
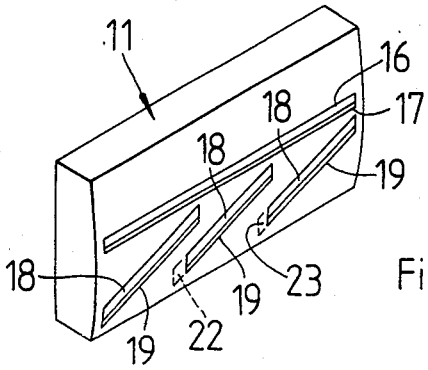
FIG. 5 is a perspective view of an embodiment with a plurality of cutting edges aligned along parallel diagonals; and, FIG. 6 is a diagrammatic representation of the motion of the blade through a hair.

In the embodiment shown in FIG. 2, the cutting edge 19 of the leading blade 18 forms a V-shape with each side of the V being diagonal to the cutting edge 17. The bottom of the V indicated at 21 is rounded to prevent inadvertently cutting the skin. While this embodiment is shown with the cutting edges 19 connected, it will be appreciated that the edges may may be disjointed. FIG. 3 illustrates this arrangement in which the V is inverted. In both FIGS. 2 and 3 the cutting edges 19 on the opposite sides of the V are aligned along opposite diagonals. In FIG. 4 a single diagonally aligned cutting edge 19 extends across the shaving head 11. In FIG. 5 a plurality of parallel cutting edges 19 are formed at the same diagonal measure from the cutting edge 17. Each cutting edge 19 is of equal length and shaves the same width.

It should be noted that the corners 22 of the blade 18 formed at the side of the blade 18 adjacent the cutting edge 19 may be shielded by embedding them in the shaving head 11 or by forming a thin plastic guard 23 thereover, as shown in FIG. 5. This shielding prevents cutting of the skin by the exposed corners 22 which would be most likely to occur in the embodiments shown in FIG. 5 or FIG. 2 if the rounded section 21 were not present.

Regardless of the number of cutting edges 19 or leading blades 18 utilized, each cutting edge should form a diagonal offset from the trailing blade 16 by about 15° to 30°. If the diagonal cutting edge 19 is offset by appreciably more than 30° it may cut into the skin, while offsetting the edge by less than about 15° does not yield substantial benefit over the conventional blade arrangement.

While I have shown my invention in several forms, it will be obvious to those skilled in the art that it is not so limited but is susceptible of various other changes and modifications without departing from the spirit thereof.

What I claim is:

1. A razor comprising:

(a) an elongated head for supporting a plurality of cutting blades at a predetermined inclination;

(b) a trailing blade supported by said head with the cutting edge of said blade aligned parallel to the longitudinal axis of said head; and (c) a pair of leading blades supported by said head with their respective cutting edges extending in opposing diagonals relative to said trailing blade with each blade extending over 50% of the length of said trailing blade such that said leading blades' cutting edges overlap near the center of said head proximal said trailing blade with said trailing blade cutting edge and each said leading blade cutting edge forming an included angle of about 15° to about 30° therebetween.

2. A razor comprising:

(a) an elongated head for supporting a plurality of cutting blades at a predetermined inclination;

(b) a trailing blade supported by said head with the cutting edge of said blade aligned parallel to the longitudinal axis of said head; and (c) a plurality of leading blades carried by said head each having a cutting edge extending diagonally to said trailing blade at the same angular measure and each extending across the same percentage of said trailing blade's length, with said trailing blade cutting edge and each said leading blade cutting edge forming an included angle of about 15° to about 30° therebetween.

* * * * *